US011286128B2

(12) United States Patent
Matsumoto

(10) Patent No.: US 11,286,128 B2
(45) Date of Patent: Mar. 29, 2022

(54) SHEET DETECTING APPARATUS AND IMAGE FORMING APPARATUS

(71) Applicant: CANON KABUSHIKI KAISHA, Tokyo (JP)

(72) Inventor: Shinichiro Matsumoto, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 119 days.

(21) Appl. No.: 16/691,720

(22) Filed: Nov. 22, 2019

(65) Prior Publication Data

US 2020/0180885 A1 Jun. 11, 2020

(30) Foreign Application Priority Data

Dec. 11, 2018 (JP) ..... JP2018-231966

(51) Int. Cl.
*B65H 7/02* (2006.01)
*B65H 9/18* (2006.01)

(52) U.S. Cl.
CPC ..... *B65H 7/02* (2013.01); *B65H 9/18* (2013.01); *B65H 2511/12* (2013.01)

(58) Field of Classification Search
CPC ... B65H 7/02; B65H 7/04; B65H 7/14; B65H 2405/111; B65H 2511/12; B65H 2553/40; B65H 2553/41; B65H 2553/412; B65H 2553/416; B65H 2553/612
See application file for complete search history.

(56) References Cited

U.S. PATENT DOCUMENTS

| | | | |
|---|---|---|---|
| 7,712,735 | B2 | 5/2010 | Chorier-Pichon et al. |
| 9,617,109 | B2 | 4/2017 | Ota et al. |
| 10,445,626 | B2 | 10/2019 | Akimoto |
| 10,706,339 | B2 | 7/2020 | Akimoto |
| 10,807,815 | B2 | 10/2020 | Tateishi |
| 11,080,572 | B2 | 8/2021 | Akimoto |

(Continued)

FOREIGN PATENT DOCUMENTS

| | | | |
|---|---|---|---|
| CN | 101566814 | A | 10/2009 |
| CN | 104943418 | A | 9/2015 |

(Continued)

OTHER PUBLICATIONS

Chinese Office Action dated Dec. 28, 2021, in related Chinese Patent Application No. 201911254687.0 (with English translation).

*Primary Examiner* — Prasad V Gokhale
(74) *Attorney, Agent, or Firm* — Venable LLP

(57) ABSTRACT

A sheet detecting apparatus includes a sheet supporting surface, a first sensor flag including a first flag portion, a first contact portion, and a third contact portion, a second sensor flag including a second flag portion, and a second contact portion, a first detection sensor configured to transit to a first state of outputting a first detection signal and to a second state of outputting a second detection signal, the first detection sensor transiting to one of the first state and the second state in response to a position of the first flag portion, and a second detection sensor configured to transit to a third state of outputting a third detection signal and to a fourth state of outputting a fourth detection signal, the second detection sensor transiting to one of the third state and the fourth state in response to a position of the second flag portion.

15 Claims, 12 Drawing Sheets

(56) References Cited

U.S. PATENT DOCUMENTS

| | | | | |
|---|---|---|---|---|
| 2009/0267294 | A1 | 10/2009 | Hojo | |
| 2011/0158729 | A1* | 6/2011 | Lee | G03G 15/5062 400/578 |
| 2013/0299681 | A1* | 11/2013 | Tsai | H04N 1/00708 250/214.1 |

FOREIGN PATENT DOCUMENTS

| | | | |
|---|---|---|---|
| CN | 105898096 | A | 8/2016 |
| CN | 108861692 | A | 11/2018 |
| EP | 1902989 | A1 | 3/2008 |
| JP | H07-112844 | A | 5/1995 |
| JP | 2005-075591 | A | 3/2005 |
| JP | 2006-240831 | A | 9/2006 |
| JP | 2011-055324 | A | 3/2011 |

* cited by examiner

FIG.4

| | OUTPUT SIGNALS OF PHOTO-INTERRUPTERS | | |
|---|---|---|---|
| | 161 | 162 | 163 |
| NO SHEET | L | L | L |
| SHEET IS PRESENT AND SMALL SIZE | H | L | L |
| SHEET IS PRESENT AND MIDDLE SIZE | H | H | L |
| SHEET IS PRESENT AND LARGE SIZE | H | H | H |

FIG.8

| | OUTPUT SIGNALS OF PHOTO-INTERRUPTERS | |
|---|---|---|
| | 61 | 62 |
| NO SHEET | L | L |
| SHEET IS PRESENT AND SMALL SIZE | H | L |
| SHEET IS PRESENT AND MIDDLE SIZE | H | H |
| SHEET IS PRESENT AND LARGE SIZE | L | H |

SHEET DETECTING APPARATUS AND IMAGE FORMING APPARATUS

BACKGROUND OF THE INVENTION

Field of the Invention

The present invention relates to a sheet detecting apparatus configured to detect a sheet and an image forming apparatus including the same.

Description of the Related Art

Hitherto, a copier including a cassette capable of loading A3, A4 and A5 size sheets is proposed as disclosed in Japanese Patent Application Laid-open No. H07-112844 for example. This copier includes a side guide configured to regulate a widthwise position of a sheet within the cassette, a sheet presence detecting lever, a first sheet width detecting lever, a second sheet width detecting lever, a first photo-sensor and a second photo-sensor. The first sheet width detecting lever is provided at a position permitting to interfere with the side guide being in contact with an end portion of an A5 size sheet and is capable of shading the first photo-sensor. The second sheet width detecting lever is provided at a position permitting to interfere with the side guide being in contact with an end portion of an A4 size sheet and is capable of shading the second photo-sensor. The sheet presence detecting lever is provided at a position permitting to contact with any size sheets of A3 to A5.

In a state in which no sheet is loaded in the cassette, the sheet presence detecting lever presses down detection portions of the first and second sheet width detecting levers and the first and second photo-sensors are both turned ON. When the cassette is inserted into a body of the copier, the sheet presence detecting lever separates from the first and second sheet width detecting levers and the first and second photo-sensors are turned OFF by the sheet loaded on the cassette. Then, in the state in which the cassette is inserted into the copier and in a case where an A5 size sheet is stored in the cassette, the first sheet width detecting lever is pushed up by the side guide and the first photo-sensor turns ON. At this time, the second photo-sensor is still kept OFF.

In a case where an A4 size sheet is stored in the cassette, the second sheet width detecting lever is pushed up by the side guide and the second photo-sensor turns ON. At this time, the first photo-sensor is still kept OFF. In a case where an A3 size sheet is stored in the cassette, the first and second photo-sensors are kept OFF because the first and second sheet width detecting levers are not pushed up by the side guide. Thus, the first and second photo-sensors are turned ON or OFF as the side guide presses up the first sheet width detecting lever or the second sheet width detecting lever at positions corresponding to the sheet sizes.

However, Japanese Patent Application Laid-open No. H07-112844 has a problem that because the respective sheet width detecting levers pivot in response to the positions of the side guide, the photo-sensors may erroneously detect in a case where a user has not moved the side guide to an appropriate position for example.

SUMMARY OF THE INVENTION

According to one aspect of the present invention, a sheet detecting apparatus includes a sheet supporting surface configured to support a sheet, a first sensor flag including a first flag portion configured to pivot around a first pivot shaft extending in an axial direction, a first contact portion configured to pivot integrally with the first flag portion and configured to contact, at a first position in the axial direction, with the sheet supported by the supporting surface, and a third contact portion configured to pivot integrally with the first flag portion and configured to contact, at a third position, with the sheet supported by the supporting surface, the third position being located on a side opposite from the first position across a second position in the axial direction, a second sensor flag including a second flag portion configured to pivot around a second pivot shaft, and a second contact portion configured to pivot integrally with the second flag portion and configured to contact, at the second position, with the sheet supported by the supporting surface, a first detection sensor configured to transit to a first state of outputting a first detection signal and to a second state of outputting a second detection signal different from the first detection signal, the first detection sensor transiting to either one of the first state and the second state in response to a position of the first flag portion, and a second detection sensor configured to transit to a third state of outputting a third detection signal and to a fourth state of outputting a fourth detection signal different from the third detection signal, the second detection sensor transiting to either one of the third state and the fourth state in response to a position of the second flag portion, wherein in a case where no sheet is disposed at the first, second and third positions, the first detection sensor is brought to the first state and the second detection sensor is brought to the third state, wherein in a case where a sheet is disposed at the first position and no sheet is disposed at the second and third positions, the first detection sensor is brought to the second state and the second detection sensor is brought to the third state, wherein in a case where a sheet is disposed at the first and second positions and no sheet is disposed at the third position, the first detection sensor is brought to the second state and the second detection sensor is brought to the fourth state, and wherein a sheet is disposed at the first, second and third positions, the first detection sensor is brought to the first state and the second detection sensor is brought to the fourth state.

Further features of the present invention will become apparent from the following description of exemplary embodiments with reference to the attached drawings.

BRIEF DESCRIPTION OF THE DRAWINGS

FIG. 4 is a table indicating relationships between respective states and respective output signals of respective photo-interrupters.

FIG. 8 is a table indicating relationships between respective states and respective output signals of respective photo-interrupters.

DESCRIPTION OF THE EMBODIMENTS

First Embodiment

Overall Configuration

Figure 1:
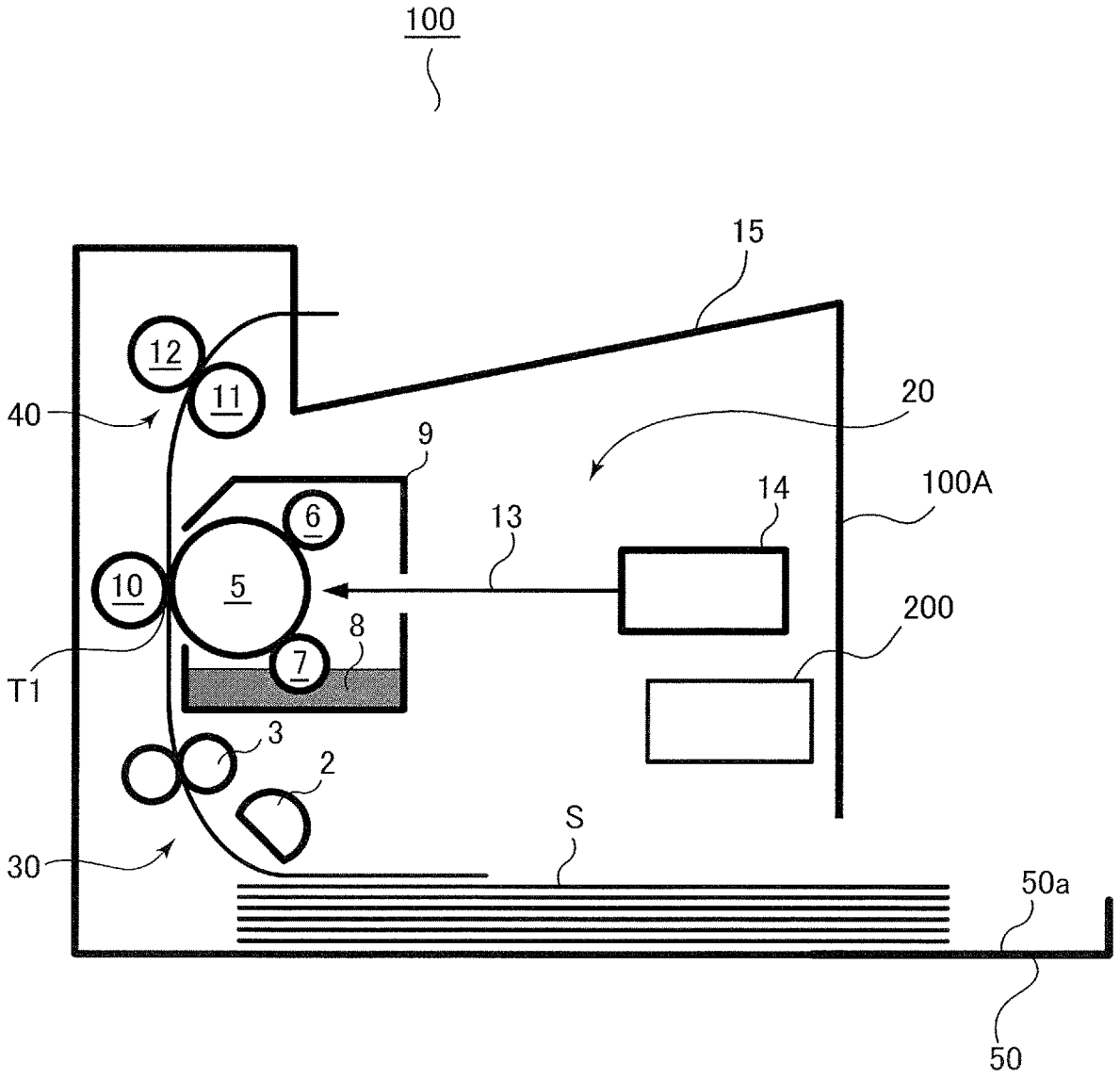
FIG. 1 is a schematic diagram illustrating an entire configuration of a printer of a first embodiment.

A printer 100 serving as an image forming apparatus of a first embodiment is an electro-photographic laser beam printer configured to form a monochrome toner image. As illustrated in FIG. 1, the printer 100 includes a sheet feeding unit 30 configured to feed a sheet, an image forming unit 20 configured to form an image on the sheet being fed and a sheet discharge roller pair not illustrated capable of discharging the sheet to a discharge tray 15.

When an instruction of forming an image is issued to the printer 100, the image forming unit 20 starts an image forming process based on image information inputted from an external computer or the like connected to the printer 100. The image forming unit 20 includes a process cartridge 9, a laser scanner 14, a transfer roller 10 and a fixing unit 40. The process cartridge 9 includes a rotatable photosensitive drum 5 and a charging roller 6, a developing sleeve 7 and toner 8 disposed along the photosensitive drum 5. The transfer roller 10 defines a transfer nip T1 together with the photosensitive drum 5. Note that while the printer 100 is a monochrome laser printer in the present embodiment, the present disclosure is not limited to that. For instance, the printer 100 may be a full-color laser beam printer.

The laser scanner 14 irradiates the photosensitive drum 5 with a laser beam 13 based on the inputted image information. Because the photosensitive drum 5 has been charged in advance by the charging roller 6 at this time, an electrostatic latent image is formed on the photosensitive drum 5 by the irradiation of the laser beam 13. After that, the electrostatic latent image is developed by the developing sleeve 7 by using the toner 8 and a monochrome toner image is formed on the photosensitive drum 5.

The sheet is fed from the sheet feeding unit 30 in parallel with the abovementioned image forming process. The sheet feeding unit 30 includes a sheet feed tray 50 disposed at a lower part of the printer 100, and the sheet feed tray 50 includes a supporting surface 50*a* capable of supporting the sheet S. The sheet feeding unit 30 also includes a pickup roller 2 and a conveyance roller pair 3. In response to the instruction of forming the image, the sheet S supported by the supporting surface 50*a* is fed by the pickup roller 2 and is conveyed to the transfer nip T1 by the conveyance roller pair 3.

At the transfer nip T1, the toner image on the photosensitive drum 5 is transferred onto the sheet S conveyed by the conveyance roller pair 3 to the transfer nip T1 by applying an electrostatic negative bias to the transfer roller 10. Residual toner left on the photosensitive drum 5 is collected by a cleaning blade not illustrated.

Predetermined heat and pressure are applied to the sheet S onto which the toner image has been transferred by a fixing roller 11 and a pressure roller 12 of the fixing unit 40 such that the toner image is melted and is adhered, i.e., is fixed, to the sheet S. The sheet that has passed through the fixing unit 40 is discharged to the discharge tray 15 by a discharge roller pair not illustrated.

Comparative Example

Figure 2A:
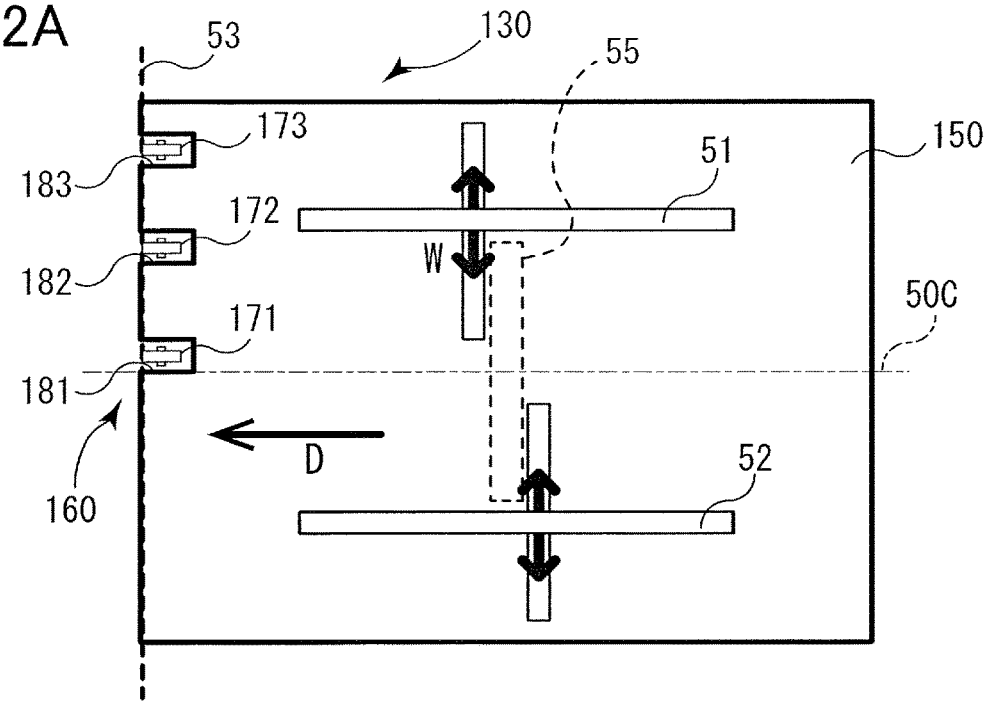
FIG. 2A is a plan view illustrating a sheet feeding unit of a comparative example.
Figure 2B:
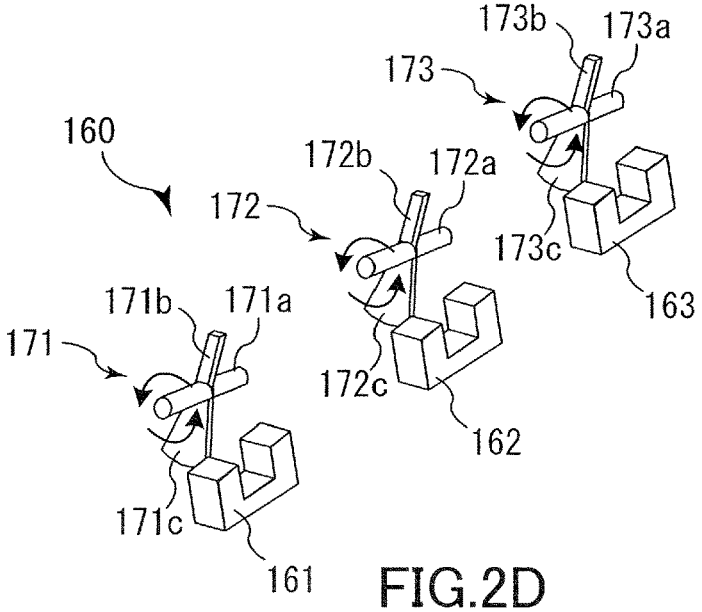
FIG. 2B is a perspective view illustrating a detection unit.

Next, a sheet feeding unit 130 of a comparative example will be described. As illustrated in FIGS. 2A and 2B, the sheet feeding unit 130 includes a sheet feed tray 150, a detection unit 160 and a pair of side regulating plates 51 and 52. The pair of side regulating plates 51 and 52 serving as first and second regulating members are movable in a width W direction orthogonal to a sheet feeding direction D and are interlocked in a direction of approaching with each other and in a direction of separating from each other by an interlock portion 55 composed of a rack and a pinion. That is, the side regulating plates 51 and 52 are disposed symmetrically about a center line 50C between the side regulating plates 51 and 52 to regulate widthwise positions of one and the other ends of the sheet loaded in the sheet feed tray 150.

Notches 181, 182 and 183 are defined on a downstream end side in the sheet feed direction D of the sheet feed tray 150 in order at positions closer to the center line 50C. The detection unit 160 includes sensor flags 171, 172 and 173 disposed respectively at the notches 181, 182 and 183 and photo-interrupters 161, 162 and 163 disposed at positions corresponding to these sensor flags 171, 172 and 173.

The sensor flag 171 includes a pivot shaft 171*a* configured to pivot and a contact portion 171*b* and a flag portion 171*c* fixed respectively to the pivot shaft 171*a*. The contact portion 171*b* is configured to contact with a sheet loaded in the sheet feed tray 150 and the flag portion 171*c* is capable of shading or opening an optical path of the photo-interrupter 161. The sensor flag 172 includes a pivot shaft 172*a* and a contact portion 172*b* and a sensor flag 172*c* fixed respectively to the pivot shaft 172*a*. The contact portion 172*b* is configured to contact with a sheet loaded in the sheet feed tray 150 and the flag portion 172*c* is capable of shading or opening an optical path of the photo-interrupter 162.

The sensor flag 173 includes a pivot shaft 173*a* configured to pivot and a contact portion 173*b* and a flag portion 173*c* fixed respectively to the pivot shaft 173*a*. The contact portion 173*b* is configured to contact with a sheet loaded in the sheet feed tray 150 and the sensor flag 173*c* is capable of shading or opening an optical path of the photo-interrupter 163.

These sensor flags 171, 172 and 173 are constructed respectively in the same manner and are in-phase in a natural condition. The photo-interrupters 161, 162 and 163 are also constructed in the same manner and are optical elements each including a light emitting element and a light receiving element provided so as to face the light emitting element. The light receiving element outputs different detection signals depending on whether the light receiving element receives a light from a light source. The light receiving element is set to output a signal of L level in a case where the light receiving element receives no light as described in Tables simply as "L" and to output a signal of H level in a case where the light receiving element receives light as described in Table simply as "H". Note that in the case where the light receiving element outputs the L level signal, a low level voltage is detected in a circuit connected to the light receiving element and in the case where the light receiving element outputs the H level signal, a high level voltage is detected in a circuit connected to the light receiving element.

Figure 2C:
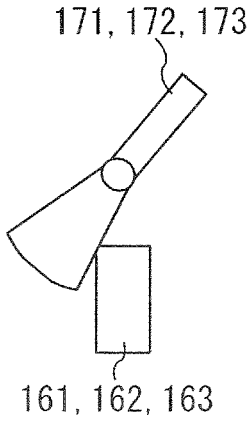
FIG. 2C is a side view illustrating the detection unit in a condition in which a sensor flag is not in contact with a sheet.

As illustrated in FIG. 2C, in a state in which no sheet is loaded in the sheet feed tray 150 and no sheet is in contact with the contact portions of the sensor flags 171, 172 and 173, the flag portions do not shade the photo-interrupters 161, 162 and 163. Therefore, the photo-interrupters 161, 162 and 163 output the L level signal.

Figure 2D:
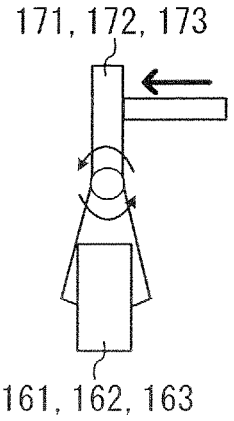
FIG. 2D is a side view illustrating the detection unit in a condition in which the sensor flag is pressed by a sheet.

When a sheet is inserted into a leading edge butting portion 53 of the sheet feed tray 150 as illustrated in FIG. 2D, the contact portions of the sensor flags 171, 172 and 173 are pressed by the sheet and the sensor flags 171, 172 and 173 pivot. Thereby, the flag portions shade the optical path of the photo-interrupters 161, 162 and 163 and the photo-interrupters 161, 162 and 163 output H level signals. In a case where the sheet is drawn out or runs out of sheets in the sheet feed tray 150, the sensor flags 171, 172 and 173 return to their original positions, i.e., to the positions as indicated in FIG. 2C, by their own weight or by an urging member such as a spring.

Figure 3:
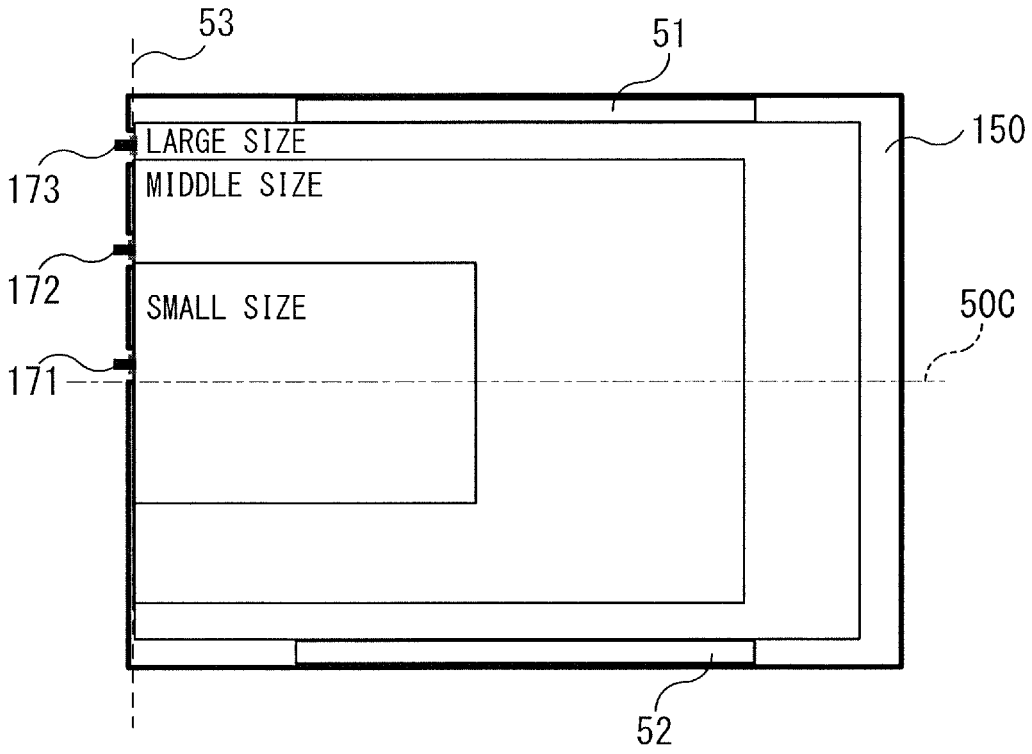
FIG. 3 is a plan view illustrating a layout relationship between sheets of respective sizes and the sensor flags.

While there are various sizes of sheets, the following description will be made by roughly dividing such sheets into three kinds of sheets of a small size sheet, a medium size sheet and a large size sheet for convenience. As illustrated in FIG. 3, the small size, the middle size and the large size sheets are aligned by the side regulating plates 51 and 52 such that a widthwise center of the sheets coincide with the center line 50C. Then, the sensor flag 171 is disposed at a position where the sensor flag 171 can come into contact with the small size, the middle size and the large size sheets. The sensor flag 172 is disposed at a position where the sensor flag 172 can come into contact with the middle size and the large size sheets and is unable to come into contact with the small size sheet. The sensor flag 173 is disposed at a position where the sensor flag 173 can come into contact with the large size sheet and is unable to come into contact with the small size and the middle size sheets.

By arranging the sensor flags 171, 172 and 173 and the photo-interrupters 161, 162 and 163 as described above, the photo-interrupters 161, 162 and 163 output signals in four states as indicated in Table in FIG. 4. That is, in a state in which no sheet is loaded in the sheet feed tray 150, the photo-interrupters 161, 162 and 163 output the L level signal, respectively. In a state in which the small size sheet is loaded in the sheet feed tray 150, the photo-interrupter 161 outputs an H level signal and the photo-interrupters 162 and 163 output L level signals.

In a state in which the middle size sheet is loaded in the sheet feed tray 150, the photo-interrupters 161 and 162 output H level signals and the photo-interrupter 163 outputs an L level signal. In a state in which the large size sheet is loaded in the sheet feed tray 150, the photo-interrupters 161, 162 and 163 output H level signals. It is possible to detect the size of the sheet loaded in the sheet feed tray 150 from the signals from the photo-interrupters 161, 162 and 163 as described above.

Sheet Feeding Unit

Figure 5A:
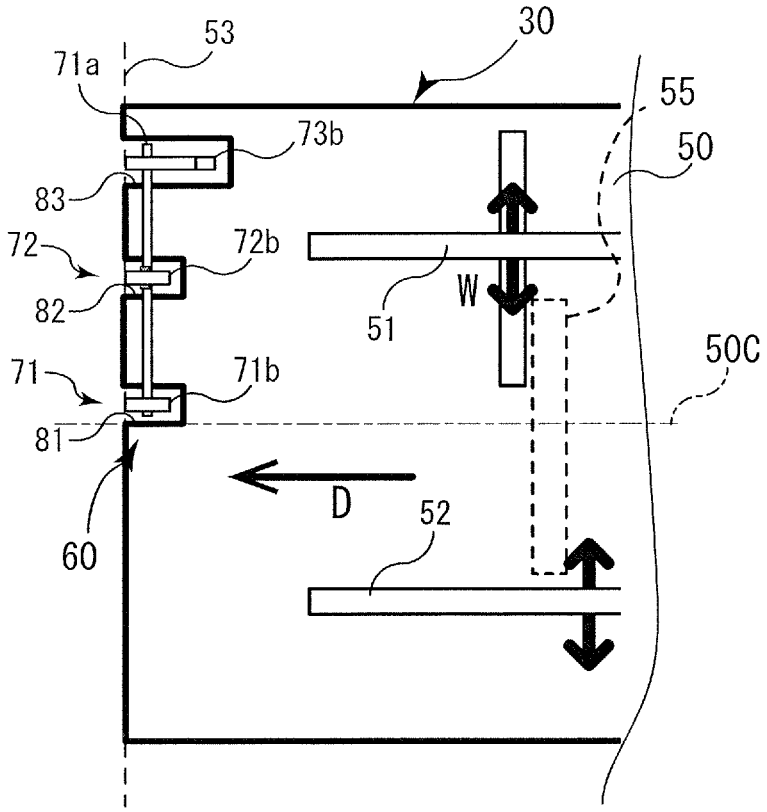
FIG. 5A is a plan view illustrating a sheet feeding unit of the first embodiment.
Figure 5B:
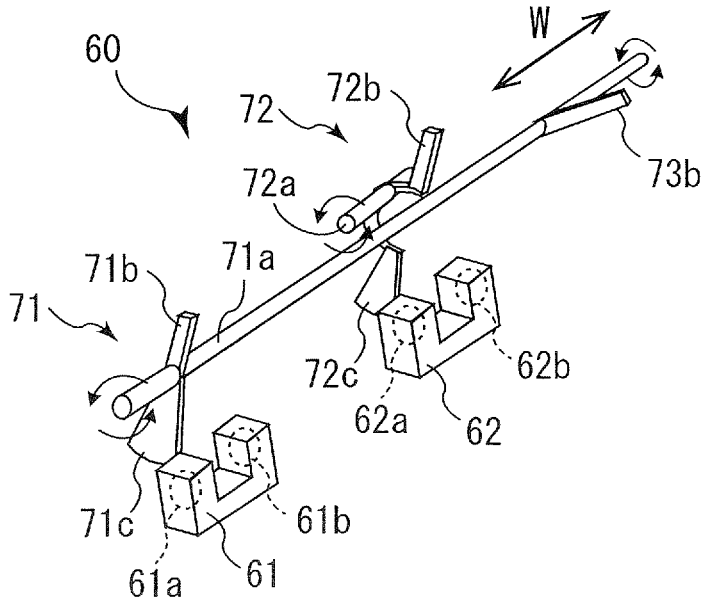
FIG. 5B is a perspective view illustrating detection units.

Next, the sheet feeding unit 30 of the present embodiment will be described. Note that components of the present embodiment similar to those of the comparative example described above will be denoted by the same reference signs and their description will be omitted here. As illustrated in FIGS. 5A and 5B, the sheet feeding unit 30 serving as a sheet detecting apparatus includes a sheet feed tray 50, a detection unit 60 and a pair of side regulating plates 51 and 52.

Notches 81, 82 and 83 are defined on a downstream end side in the sheet feed direction D of the sheet feed tray 50 in order at positions closer to the center line 50C. The notch 81 serving as a first notch, the notch 82 serving as a second notch and the notch 83 serving as a third notch include contact portions 71*b*, 72*b* and 73*b* respectively penetrating through the notches. The notch 83 is formed to be longer than the notches 81 and 82 in the sheet feed direction D, i.e., in the insert direction of the sheet inserted toward the supporting surface 50*a*. The detection unit 60 includes sensor flags 71 and 72 and the photo-interrupters 61 and 62 and is capable of detecting the sheet supported by the sheet feed tray 50. The detection unit 60 is disposed in a printer body 100A (see FIG. 1) serving as an apparatus body in which the image forming unit 20 is provided. The supporting surface 50*a* is disposed in the printer body 100A.

The sensor flag 71 serving as a first sensor flag includes a pivot shaft 71*a* serving as a first pivot shaft extending in the width direction W, i.e., an axial direction, contact portions 71*b* and 73*b*, and a flag portion 71*c*. The contact portions 71*b* and 73*b* and the flag portion 71*c* are fixed to the pivot shaft 71*a* and are configured to pivot integrally with the pivot shaft 71*a*. The contact portion 71*b* serving as a first contact portion projects out of the notch 81 toward the supporting surface 50*a* side and is configured to contact with the sheet at the first position. The contact portion 73*b* serving as a third contact portion projects out of the notch 83 toward the supporting surface 50*a* side and is configured to contact with the sheet S at the third position. The third position is a position on a side opposite from the first position across a second position in terms of the width direction W. The first, second and third positions are located on a downstream end side of the supporting surface 50*a* in the sheet feed direction D, i.e., in the insert direction of the sheet inserted toward the supporting surface 50*a*. The flag portion 71*c* serving as a first flag portion is capable of shading or opening an optical path of the photo-interrupter 61.

The sensor flag 72 serving as a second sensor flag includes a pivot shaft 72*a* serving as a second pivot shaft extending in the width direction W and a contact portion 72*b* and a flag portion 72*c* fixed respectively to the pivot shaft 72*a* and pivoting integrally with the pivot shaft 72*a*. The contact portion 72*b* serving as a second contact portion projects out of the notch 82 toward the supporting surface 50*a* and is configured to contact with the sheet S at the second position. The flag portion 72*c* serving as a second flag portion is capable of shading or opening an optical path of the photo-interrupter 62 serving as a second detection sensor. The pivot shaft 72*a* extends in parallel with the pivot shaft 71*a*, and the contact portion 72*b* and the flag portion 72*c* are disposed on sides opposite from each other across the pivot shaft 71*a* when viewed from the width direction W. Note that the pivot shaft 72*a* may extend in a direction intersecting with the pivot shaft 71*a*.

The photo-interrupters 61 and 62 are constructed in the same manner and are optical elements respectively including a light emitting element and a light receiving element provided so as to face the light emitting element. The light receiving element outputs different detection signals depending on whether the light receiving element has received light from a light source. Specifically, the photo-interrupter 61 includes a light emitting element 61*a* and a light receiving element 61*b*, and the photo-interrupter 62 includes a light emitting element 62*a* and a light receiving element 62*b*. In the present embodiment, a state in which the optical path of the photo-interrupter 61 is not shaded and an L level signal is outputted as a first detection signal is set to be a first state. A state in which the optical path of the photo-interrupter 61 is shaded and an H level signal is outputted as a second detection signal is set to be a second state. That is, the photo-interrupter 61 is capable of transiting from the first state to the second state and vice versa and is brought to either one of the first state and the second state in response to a position of the flag portion 71*c* of the sensor flag 71.

Still further, a state in which the optical path of the photo-interrupter 62 is not shaded and an L level signal is outputted as a third detection signal is set to be a third state. A state in which the optical path of the photo-interrupter 62 is shaded and an H level signal is outputted as a fourth detection signal is set to be a fourth state. That is, the photo-interrupter 62 is capable of transiting from the third state to the fourth state and vice versa and is brought to either one of the third state and the fourth state in response to a position of the flag portion 72*c* of the sensor flag 72.

Figure 6A:
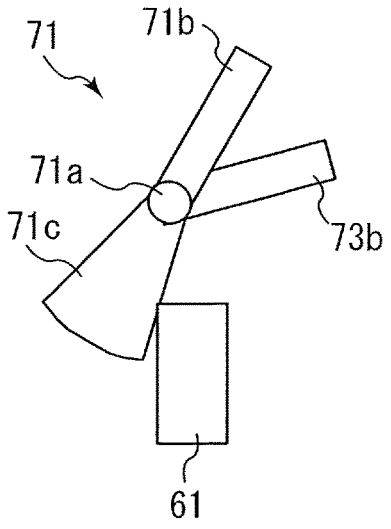
FIG. 6A is a side view illustrating the detection unit in a condition in which the sensor flag is not in contact with a sheet.

As illustrated in FIG. 6A, an angle of the contact portion 73*b* mounted to the pivot shaft 71*a* is different from that of the contact portion 71*b*, and the contact portion 73*b* extends with an angle closer to horizontal as compared to that of the contact portion 71*b*. Therefore, the contact portion 73*b* contacts with the sheet upstream more than the contact portion 71*b* in the sheet feed direction D. In other words, the contact portion 73*b* projects upstream more than the contact portion 71*b* in the insert direction of the sheet inserted in the sheet feed direction D, i.e., toward the supporting surface 50*a*, in a state in which the flag portion 71*c* is positioned at a standby position. In a state in which no sheet is loaded in the sheet feed tray 50 and the contact portions 71*b* and 73*b* contact with no sheet, the flag portion 71*c* is positioned at the standby position and does not shade the optical path of the photo-interrupter 61. Due to that, the photo-interrupter 61 outputs an L level signal.

Figure 6B:
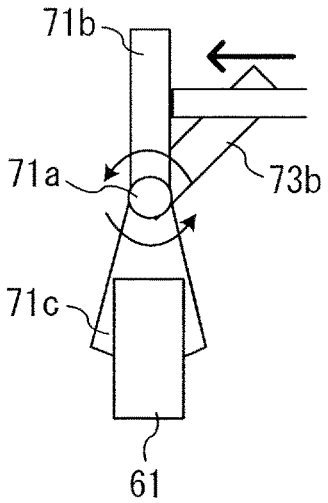
FIG. 6B is a side view illustrating a condition in which the sensor flag has pivoted by a first pivot angle.

When the sheet is inserted into the leading edge butting portion 53 of the sheet feed tray 150 (see FIG. 5A) and the contact portion 71*b* is pressed by the sheet as illustrated in FIG. 6B, the flag portion 71*c* pivots by a first pivot angle from the standby position. At this time, the flag portion 71*c* shades the optical path of the photo-interrupter 61, and the photo-interrupter 61 outputs an H level signal.

Figure 6C:
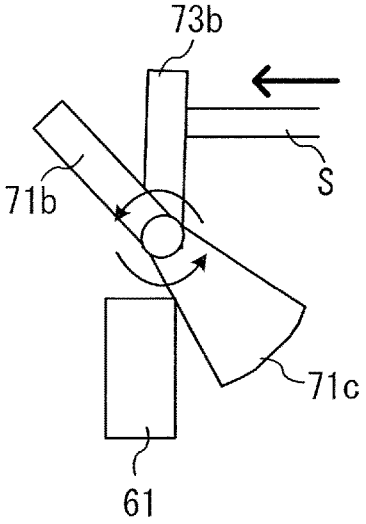
FIG. 6C is a side view illustrating a condition in which the sensor flag has pivoted by a second pivot angle.

When the contact portion 73*b* is pressed by a sheet as illustrated in FIG. 6C, the flag portion 71*c* pivots from the standby position by a second pivot angle which is greater than the first pivot angle. At this time, because the flag portion 71*c* pivots by exceeding the position of shading the optical path of the photo-interrupter 61, i.e., the position as indicated in FIG. 6B, the photo-interrupter 61 outputs an L level signal. That is, the photo-interrupter 61 transits in order of the first state, the second state and the third state as the flag portion 71*c* pivots as described above. In a case where all sheets are drawn out of the sheet feed tray 50 or no sheet is left in the sheet feed tray 50, the sensor flags 71 and 72 return to their original positions as indicated in FIG. 5B by their own weights or by an urging member such as a spring.

Detection of Sheet Size

Figure 7:
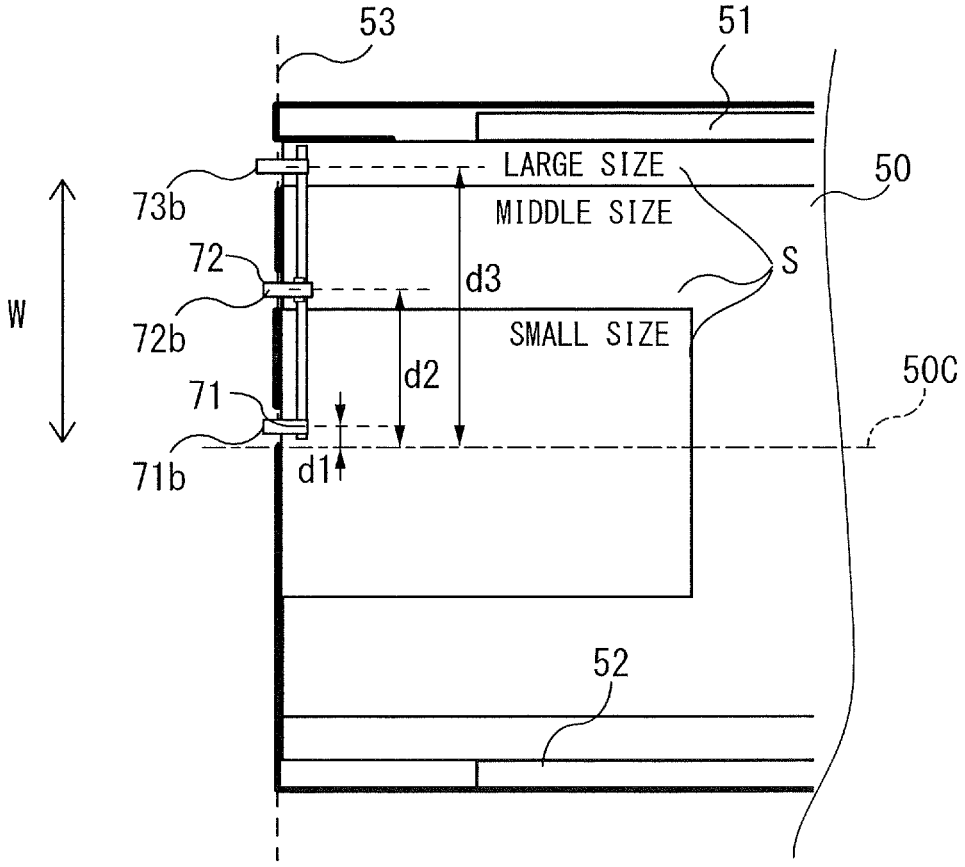
FIG. 7 is a plan view illustrating a layout relationship between the respective size sheets and the contact portions.

Next, a method for detecting the small size, middle size and large size sheets, like the comparative example described above, will be described. As illustrated in FIG. 7, the small size, middle size and large size sheets are aligned by the side regulating plates 51 and 52 such that a widthwise center of the sheets coincides with the center line 50C. The middle size sheet serving as a second size sheet is longer, in terms of the width direction W, than the small size sheet serving as a first size sheet. The large size sheet serving as a third size sheet is longer, in terms of the width direction W, than the middle size sheet.

Then, the contact portion 71*b* is disposed at the first position where the contact portion 71*b* can contact with the small size, middle size and large size sheets. That is, the first position where the contact portion 71*b* is positioned is distant from the center line 50C by a first distance d1 which is a distance of a half or less of a width of the small size sheet. The contact portion 72*b* is disposed at a second position where the contact portion 72*b* can contact with the middle size and large size sheets and is unable to contact with the small size sheet. That is, the contact portion 72*b* is disposed at a position distant from the center line 50C by a second distance d2 which is a distance more than a half of the width of the small size sheet and a half or less of a width of the middle size sheet. The second distance d2 is greater than the first distance d1.

The contact portion 73*b* is disposed at a third position where the contact portion 73*b* can contact with the large size and is unable to contact with the small size and middle size sheets. That is, the contact portion 73*b* is disposed at a position distant from the center line 50C by a third distance d3 which is a distance more than a half of the width of the middle size sheet and a half or less of a width of the large size sheet. The third distance d3 is greater than the second distance d2.

By arranging the sensor flags 71 and 72 and the photo-interrupters 61 and 62 as described above, the photo-interrupters 61 and 62 output signals in four states described later as indicated in Table in FIG. 8. That is, in a non-sheet state in which no sheet is loaded in the sheet feed tray 50 and no sheet is disposed at the first, second and third positions, the photo-interrupters 61 and 62 output L level signals, respectively.

In a state in which the small size sheet is loaded in the sheet feed tray 50 and in which the sheet is disposed at the first position and no sheet is disposed at the second and third positions, the photo-interrupter 61 outputs an H level signal and the photo-interrupter 62 outputs an L level signal. In a state in which the middle size sheet is loaded in the sheet feed tray 50 and in which the sheet is disposed at the first and second positions and no sheet is disposed at the third position, the photo-interrupters 61 and 62 output H level signals.

In a state in which the large size sheet is loaded in the sheet feed tray 50 and in which the sheet is disposed at the first, second and third positions, the photo-interrupter 61 outputs an L level signal and the photo-interrupter 62 outputs an H level signal. As compared to the comparative example described with reference to FIG. 4 and in the case where the large size sheet is loaded, while the photo-interrupter 161 outputs the H level signal, the photo-interrupter 61 of the present embodiment outputs the L level signal. It is because the flag portion 71*c* pivots exceeding the optical path of the photo-interrupter 61 in a case where the sheet is inserted into the leading edge butting portion 53 and the contact portion 73*b* is pressed by the leading edge of the sheet.

In the four states as described above, it is possible to detect the size of the sheet loaded in the sheet feed tray 50 and the non-sheet state by outputting the signals outputted from the photo-interrupters 61 and 62 to the control unit 200 (see FIG. 1). Still further, because the contact portions 71*b*, 72*b* and 73*b* contact directly with the sheet loaded in the sheet feed tray 50 and pivot the flag portions 71*c* and 72*c*, the sheet will not be erroneously detected even if the user forgets to operate the side regulating plates 51 and 52. Still further, the two photo-interrupters 61 and 62 are used in the present embodiment in detecting the four states described above, so that it is possible to reduce by one photo-interrupter, thus cutting costs as compared to the comparative example described above. Still further, as compared to a case where the pivot shaft, the contact portion and the flag portion are provided respectively for one photo-interrupter, this arrangement makes it possible to omit the pivot shaft, the bearing and the flag portion, thus cutting costs.

Figure 9:
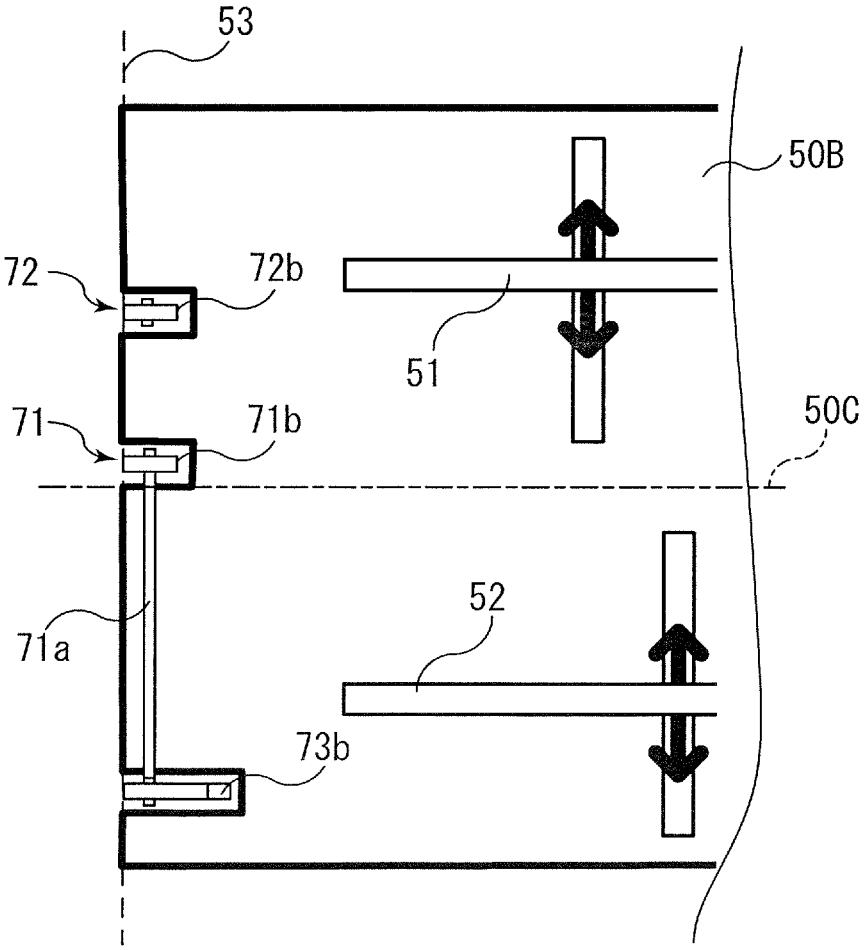
FIG. 9 is a plan view illustrating a layout of the contact portions according to a first modified example.
Figure 10:
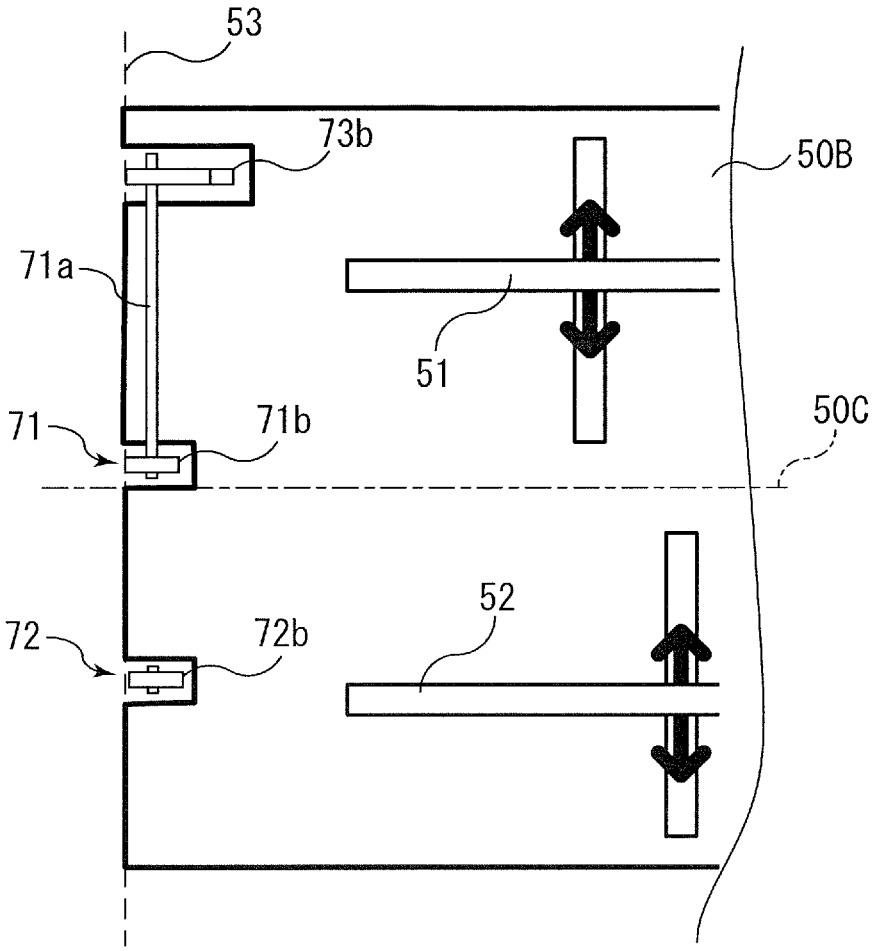
FIG. 10 is a plan view illustrating a layout of the contact portions according to a second modified example.

Note that while the contact portions 71*b*, 72*b* and 73*b* are all disposed at one widthwise side of the center line 50C in the present embodiment, the present disclosure is not limited to such arrangement. For instance, as illustrated in FIG. 9, the contact portions 71*b* and 72*b* may be disposed at one widthwise side of the center line 50C and the contact portion 73*b* may be disposed at another widthwise side of the center line 50C. Still further, as illustrated in FIG. 10, the contact portions 71*b* and 73*b* may be disposed at one widthwise side of the center line 50C and the contact portion 72*b* may be disposed at another widthwise side of the center line 50C.

Second Embodiment

Next, a second embodiment of the present disclosure will be described. The second embodiment is different from the first embodiment in that sheet aligning positions are different in terms of the sheet widthwise direction. Therefore, the same components with those of the first embodiment will not be illustrated or will be described by denoting the same reference numerals.

Figure 11:
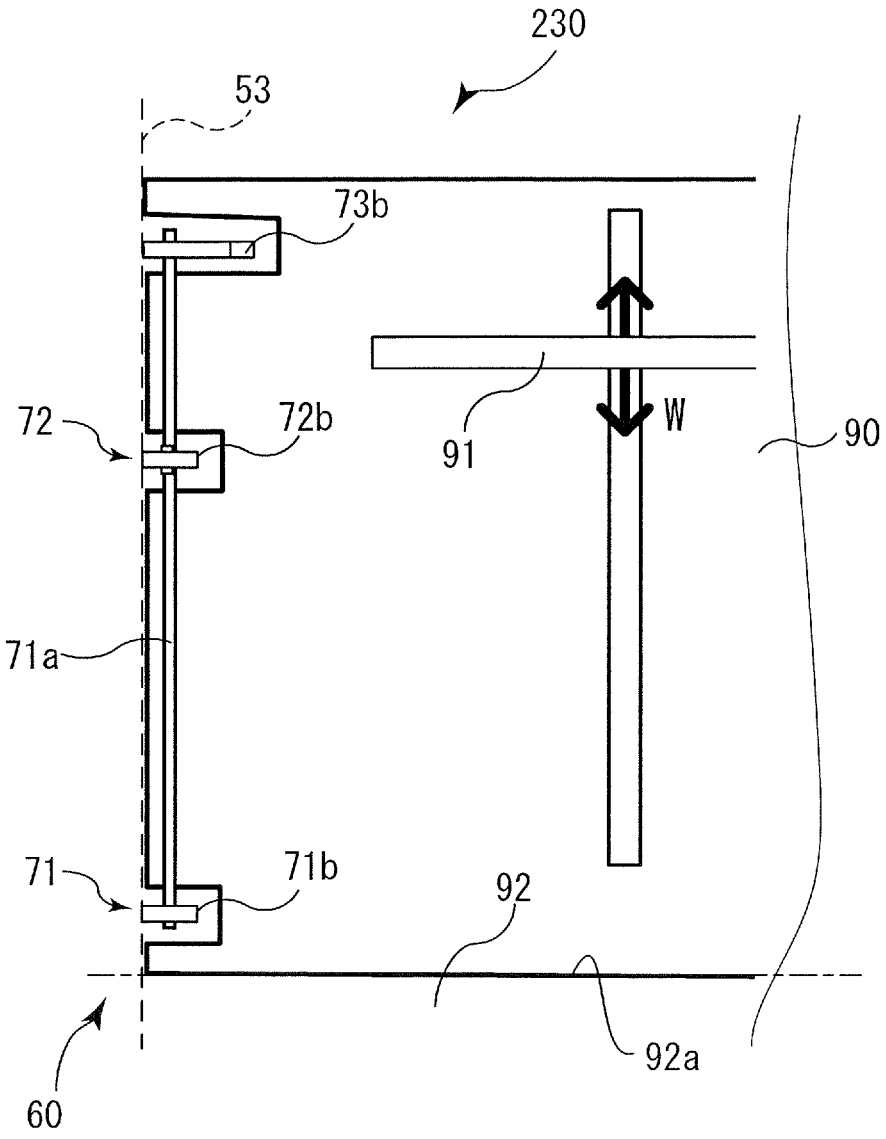
FIG. 11 is a plan view illustrating a sheet feeding unit of a second embodiment.

As illustrated in FIG. 11, a sheet feeding unit 230 serving as a sheet detecting apparatus of the present embodiment includes a sheet feed tray 90, a detection unit 60, a side regulating plate 91 and a reference wall 92. The reference wall 92 serving as a second regulating member is a fixed member provided on a frame of the sheet feed tray 90 or the printer 100. The reference wall 92 includes a butting surface 92*a* against which one widthwise end portion of a sheet butts. The side regulating plate 91 serving as a first regulating member is supported movably in the width direction W and regulates a position of another widthwise end portion of the sheet whose one end portion is butting against the butting surface 92*a*. That is, the side regulating plate 91 is provided to be movable in the width direction W with respect to a supporting surface of the sheet feed tray 90, and the reference wall 92 is provided to be unmovable with respect to the supporting surface of the sheet feed tray 90.

Figure 12:
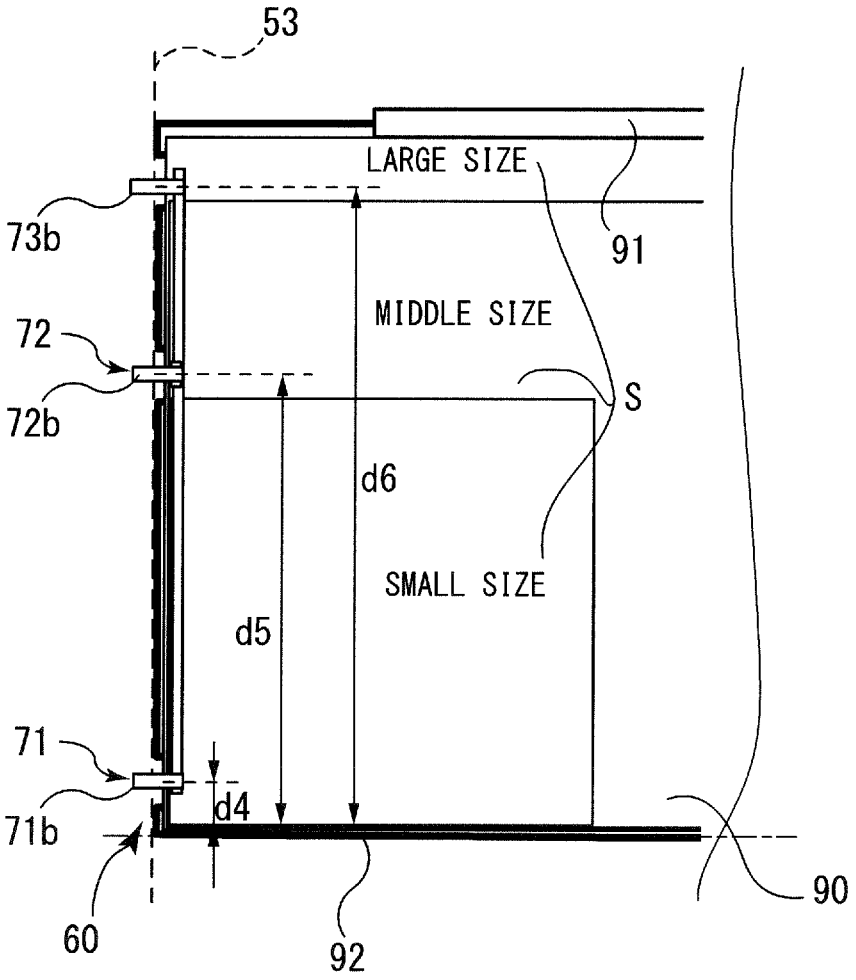
FIG. 12 is a plan view indicating a layout relationship of respective size sheets and contact portions.

As illustrated in FIG. 12, small size, middle size and large size sheets are aligned in a condition in which the one widthwise end portion of the sheet butts against the reference wall 92 by the reference wall 92 and the side regulating plate 91.

Then, the contact portion 71*b* is disposed at a first position where the contact portion 71*b* is configured to contact with the small size, middle size and large size sheets. That is, the first position where the contact portion 71*b* is positioned is a position distant from the reference wall 92 by a fourth distance d4 which is a distance less than a width of the small size sheet. The contact portion 72*b* is disposed at a second position where the contact portion 72*b* is configured to contact with the middle size and large size sheets and is uncontactable with the small size sheet. That is, the second position where the contact portion 72*b* is positioned is a position distant from the reference wall 92 by a fifth distance d5 which is a distance more than the width of the small size sheet and less than a width of the middle size sheet. The fifth distance d5 is greater than the fourth distance d4.

The contact portion 73*b* is disposed at a third position where the contact portion 73*b* is configured to contact with the large size sheet and is uncontactable with the small size and middle size sheets. That is, the third position where the contact portion 73*b* is positioned is a position distant from the reference wall 92 by a sixth distance d6 which is a distance more than the width of the middle size sheet and less than the width of the large size sheet. The sixth distance d6 is greater than the fifth distance d5. Since the method for detecting the sheet size is the same with that of the first embodiment, its description will be omitted here.

As described above, it is possible to directly detect the sheet and to reduce erroneous detection also in a mode of loading the sheet while butting against the reference wall 92. It is also possible to cut costs because the three types of sheet sizes and the non-sheet state by the two photo-interrupters.

Note that although the contact portions 71*b*, 72*b* and 73*b* have been disposed at widthwise different positions to detect the sheet size based on the width of the sheet in any embodiments described above, the present disclosure is not limited to such arrangement. That is, the contact portions 71*b*, 72*b* and 73*b* may be disposed at positions different from each other in a direction along a plane direction of the supporting surface 50*a* of the sheet feed tray 50 as long as they are contactable respectively with different size sheets. For instance, the contact portions 71*b*, 72*b* and 73*b* may be disposed at positions different in the sheet feed direction D to detect the sheet sizes based on lengths in the sheet feed direction D of the sheets. Still further, the insert direction of the sheet inserted toward the supporting surface 50*a* and the sheet feed direction D may not be parallel from each other and may intersect with each other. For instance, the sheet insert direction may be orthogonal to the sheet feed direction D.

Still further, while the flag portions 71*c* and 72*c* have been disposed such that the photo-interrupters 61 and 62 are not shaded in a state in which the contact portions of the sensor flags 71 and 72 are not pressed by the sheet in any of the embodiments described above, the present disclosure is not limited to such arrangement. That is, it is also possible to arrange such the flag portions 71*c* and 72*c* shade the photo-interrupters 61 and 62 in a natural state. At this time, it is preferable to provide the flag portions capable of shading the photo-interrupter 61 at two circumferentially different positions.

Still further, while the sensor flags 71 and 72 have included the pivot shafts 71*a* and 72*a* respectively in any embodiments described above, the present disclosure is not limited to such arrangement. For instance, the sensor flags 71 and 72 may respectively include bearings capable of pivotally supporting a pivot shaft extending from the frame of the printer 100 or the sheet feed tray 50, and the contact portion and the flag portion may be fixed to the bearing.

While the interrupter which is a transmission type photo-sensor has been used in any of the embodiments described above, the present disclosure is not limited to such arrangement. For instance, a reflection type photo-sensor including a light receiving element receiving light reflected by a flag portion may be used, and a magnet sensor or a contact type sensor may be used instead of the optical sensor.

Still further, while the sheet feed tray 50 of a type not drawn out of the printer 100 has been used in any of the embodiments described above, the present disclosure is not limited to such arrangement. For instance, the present disclosure is also applicable to a cassette that can be drawn out of and attachable to the printer 100, to a large volume deck connected to a side surface of the printer 100 and others. In this case, the detection unit 60 is disposed within the printer body 100A (see FIG. 1).

Still further, while the description has been made by exemplifying the detection unit detecting the respective states in which the thee size sheets are loaded and the non-sheet state in any of the embodiments described above, the present disclosure is not limited to such arrangement. For instance, the present disclosure is applicable to any arrangement in which n−1 photo-sensors are provided to detect n kinds (n>0) of sizes of sheets.

Still further, while the description has been made by using the electro-photographic printer 100 in any of the embodiments described above, the present disclosure is not limited to such arrangement. For instance, the present disclosure is applicable also to an ink jet type image forming apparatus configured to form an image on a sheet by discharging ink droplet from a nozzle.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-231966, filed Dec. 11, 2018, which is hereby incorporated by reference herein in its entirety.

What is claimed is:

1. A sheet detecting apparatus comprising:

a sheet supporting surface configured to support a sheet;

a first sensor flag comprising a first flag portion configured to pivot around a first pivot shaft extending in an axial direction, a first contact portion configured to pivot integrally with the first flag portion and configured to contact, at a first position in the axial direction, with the sheet supported by the supporting surface, and a third contact portion configured to pivot integrally with the first flag portion and configured to contact, at a third position, with the sheet supported by the supporting surface, the third position being located on a side opposite from the first position across a second position in the axial direction;

a second sensor flag comprising a second flag portion configured to pivot around a second pivot shaft, and a second contact portion configured to pivot integrally with the second flag portion and configured to contact, at the second position, with the sheet supported by the supporting surface;

a first detection sensor configured to transit to a first state of outputting a first detection signal and to a second state of outputting a second detection signal different from the first detection signal, the first detection sensor transiting to either one of the first state and the second state in response to a position of the first flag portion; and a second detection sensor configured to transit to a third state of outputting a third detection signal and to a fourth state of outputting a fourth detection signal different from the third detection signal, the second detection sensor transiting to either one of the third state and the fourth state in response to a position of the second flag portion, wherein in a case where no sheet is disposed at the first, second and third positions, the first detection sensor is brought to the first state and the second detection sensor is brought to the third state, wherein in a case where a sheet is disposed at the first position and no sheet is disposed at the second and third positions, the first detection sensor is brought to the second state and the second detection sensor is brought to the third state, wherein in a case where a sheet is disposed at the first and second positions and no sheet is disposed at the third position, the first detection sensor is brought to the second state and the second detection sensor is brought to the fourth state, and wherein a sheet is disposed at the first, second and third positions, the first detection sensor is brought to the first state and the second detection sensor is brought to the fourth state.

2. The sheet detecting apparatus according to claim 1, wherein the first detection sensor transits in order of the first state, the second state and the first state in a case where the third contact portion is pressed by the sheet disposed at the third position.

3. The sheet detecting apparatus according to claim 1, wherein the first flag portion is positioned at a standby position in a case where no sheet is disposed at the first and third positions, pivots by a first pivot angle from the standby position around the first pivot shaft in a case where the first detection sensor is brought to the second state as the first contact portion is pressed by a sheet positioned at the first position, and pivots by a second pivot angle which is greater than the first pivot angle from the standby position around the first pivot shaft in a case where the first detection sensor is brought to the second state as the third contact portion is pressed by a sheet positioned at the third position.

4. The sheet detecting apparatus according to claim 3, wherein the third contact portion projects upstream more than the first contact portion in an insert direction in which a sheet is inserted toward the supporting surface in a state where the first flag portion is positioned at the standby position.

5. The sheet detecting apparatus according to claim 1, wherein the first flag portion, the first contact portion and the third contact portion are fixed to the first pivot shaft, and wherein the second flag portion and the second contact portion are fixed to the second pivot shaft such that the second flag portion and the second contact portion are disposed on a side opposite to each other across the first pivot shaft when viewed in the axial direction.

6. The sheet detecting apparatus according to claim 1, further comprising:

a first regulating member configured to regulate one end portion, in the axial direction, of the sheet supported by the supporting surface; and a second regulating member configured to regulate the other end portion, in the axial direction, of the sheet supported by the supporting surface, wherein the supporting surface is configured to support a first size sheet, a second size sheet which is longer, in terms of the axial direction, than the first size sheet, and a third size sheet which is longer, in terms of the axial direction, than the second size sheet, wherein the first detection sensor is brought to the second state and the second detection sensor is brought to the third state in a case where a position of the first size sheet is regulated by the first and second regulating members in the axial direction, wherein the first detection sensor is brought to the second state and the second detection sensor is brought to the fourth state in a case where a position of the second size sheet is regulated by the first and second regulating members in the axial direction, and wherein the first detection sensor is brought to the first state and the second detection sensor is brought to the fourth state in a case where a position of the third size sheet is regulated by the first and second regulating members in the axial direction.

7. The sheet detecting apparatus according to claim 6, further comprising an interlock portion configured to interlock the first and second regulating members in a direction of approaching with each other and in a direction of separating from each other, wherein the first and second regulating members are provided to be movable respectively in the axial direction, wherein the first position is a position distant by a first distance in the axial direction from a center line between the first and second regulating members in the axial direction, wherein the second position is a position distant by a second distance which is greater than the first distance in the axial direction from the center line, and wherein the third position is a position distant by a third distance which is greater than the second distance in the axial direction from the center line.

8. The sheet detecting apparatus according to claim 6, wherein the first regulating member is provided to be movable in the axial direction, wherein the second regulating member comprises a butting surface against which the other end portion, in the axial direction, of a sheet butts and is provided to be unmovable with respect to the supporting surface, wherein the first position is a position distant from the butting surface by a fourth distance in the axial direction, wherein the second position is a position distant from the butting surface by a fifth distance which is greater than the fourth distance in the axial direction, and wherein the third position is a position distant from the butting surface by a sixth distance which is greater than the fifth distance in the axial direction.

9. The sheet detecting apparatus according to claim 1, wherein the first, second and third positions are located on a downstream end side of the supporting surface in an insert direction in which a sheet is inserted toward the supporting surface.

10. The sheet detecting apparatus according to claim 1, wherein the supporting surface comprises a first notch provided at a position corresponding to the first position and through which the first contact portion penetrates, a second notch provided at a position corresponding to the second position and through which the second contact portion penetrates, and a third notch provided at a position corresponding to the third position and through which the third contact portion penetrates.

11. The sheet detecting apparatus according to claim 10, wherein the third notch is defined to be longer than the first and second notches in an insert direction in which the sheet is inserted toward the supporting surface.

12. The sheet detecting apparatus according to claim 1, wherein the first and second detection sensors comprise a light emitting element and a light receiving element, respectively.

13. The sheet detecting apparatus according to claim 1, wherein the second pivot shaft extends in the axial direction.

14. An image forming apparatus comprising:

the sheet detecting apparatus as set forth in claim 1; and an image forming unit configured to form an image on a sheet.

15. The image forming apparatus according to claim 14, wherein the supporting surface is disposed in an apparatus body in which the image forming unit is provided, and wherein the first and second sensor flags and the first and second detection sensors are disposed in the apparatus body.

* * * * *